US008048381B2

(12) United States Patent
Hunsinger et al.

(10) Patent No.: US 8,048,381 B2
(45) Date of Patent: Nov. 1, 2011

(54) APPARATUS AND METHOD FOR OPTIMIZING EXHAUST GAS BURN OUT IN COMBUSTION PLANTS

(75) Inventors: Hans Hunsinger, Weingarten (DE); Hubert Keller, Karlsruhe (DE); Stephan Zipser, Karlsruhe (DE); Hans-Heinz Frey, Reilingen (DE)

(73) Assignee: Forschungszentrum Karlsruhe GmbH, Karlsruhe (DE)

( * ) Notice: Subject to any disclaimer, the term of this patent is extended or adjusted under 35 U.S.C. 154(b) by 1514 days.

(21) Appl. No.: 11/362,588

(22) Filed: Feb. 24, 2006

(65) Prior Publication Data

US 2006/0140825 A1 Jun. 29, 2006

Related U.S. Application Data

(63) Continuation-in-part of application No. PCT/EP2004/011039, filed on Oct. 2, 2004.

(30) Foreign Application Priority Data

Oct. 11, 2003 (DE) ..... 103 47 340

(51) Int. Cl.

| | |
|---|---|
| ***B01D 50/00*** | (2006.01) |
| *B01D 53/34* | (2006.01) |
| *B01J 19/00* | (2006.01) |
| *B01J 8/18* | (2006.01) |
| *F27B 15/00* | (2006.01) |
| *F23J 15/00* | (2006.01) |
| *F23B 90/00* | (2006.01) |

(52) U.S. Cl. ..... 422/168; 422/129; 422/139; 110/203; 110/341

(58) Field of Classification Search ..... 422/168, 422/163, 129, 139; 110/341, 203, 264
See application file for complete search history.

(56) References Cited

U.S. PATENT DOCUMENTS

| | | | | |
|---|---|---|---|---|
| 4,539,588 | A | 9/1985 | Ariessohn et al. | |
| 4,867,079 | A * | 9/1989 | Shang et al. | 110/264 |
| 5,052,310 | A * | 10/1991 | Goff et al. | 110/234 |
| 5,252,060 | A | 10/1993 | McKinnon et al. | |
| 5,606,924 | A * | 3/1997 | Martin et al. | 110/341 |
| 5,890,444 | A * | 4/1999 | Martin et al. | 110/346 |
| 6,655,304 | B1 * | 12/2003 | Barlow | 110/347 |

FOREIGN PATENT DOCUMENTS

| | | |
|---|---|---|
| CH | 520 897 | 5/1972 |
| DE | 35 37 945 | 4/1987 |
| EP | 0 661 500 | 7/1995 |
| EP | 0 312 818 | 4/1998 |
| JP | 61 143615 | 7/1986 |

* cited by examiner

*Primary Examiner* — Walter Griffin
*Assistant Examiner* — Natasha Young
(74) *Attorney, Agent, or Firm* — Klaus J. Bach

(57) ABSTRACT

In an apparatus and method for optimizing the exhaust gas burnout in combustion plants having a solid bed combustion zone and an exhaust gas burnout zone wherein oxygen-containing gas is injected into the exhaust gas flow in the burnout zone by way of a plurality of secondary gas injection nozzles, wherein each injection nozzle is provided with a control valve, means are provided for determining the presence of incompletely burned exhaust gas components in the exhaust gas burn out zone and a control unit converts the signals into control signals by which the valves or group of valves are individually controlled so as to inject oxygen containing gas into the exhaust gas flow in order to concentrate the injection of the oxygen containing secondary gas into the areas in which incompletely burned exhaust gas components are present.

4 Claims, 3 Drawing Sheets

APPARATUS AND METHOD FOR OPTIMIZING EXHAUST GAS BURN OUT IN COMBUSTION PLANTS

This is a Continuation-In-Part Application of International Application PCT/EP2004/011039 filed Oct. 2, 2004 and claiming the priority of German application 103 47 340.8 filed Oct. 11, 2003.

BACKGROUND OF THE INVENTION

The invention relates to an apparatus for optimizing the exhaust gas burn out in combustion plants with a solid bed combustion zone and an exhaust gas burn-out zone, comprising several controllable nozzles for introducing oxygen containing secondary air into the exhaust gas burn-out zone, wherein an oxygen measuring device and/or combustion chamber temperature measuring devices for determining the total amount of secondary and primary air in the exhaust gas are provided.

As a result of the highly heterogeneous composition of certain combustion material such as waste materials or biomasses, the heat value of the combustion material varies greatly. In combustion systems with grate combustion therefore complicated and expensive combustion controls including infrared detectors (IR cameras, infrared cameras) are used. The combustion conditions in combustion chambers with grate combustion can be determined on the basis of the infra red radiation of the combustion material bed using an IR camera. The wavelength (3.9 μm) is in a range in which combustion gases have no emissivity. Using this information, the various primary gas flows are controlled which flow through the bed of solids. In this way, an essentially complete burn-out of the slag or bed ash can be achieved.

The exhaust gas leaving the combustion chamber (solid bed combustion zone) of such a non-uniform combustion includes areas with high concentrations of incompletely burned compounds such as CO, hydrocarbons or soot. The gas flow leaving the combustion chamber includes flow streaks with largely varying local and time dependent variations. These streaks of unburned exhaust gas components extend through the exhaust gas burnout zone up to the first radiation structure.

The oxygen concentrations in the exhaust gas burnout zone are very low and additionally, unevenly distributed. There is insufficient time and insufficient turbulence for a complete burn-out of the exhaust gases. A complete burn out of the exhaust gases can therefore be realized only with a controlled local introduction of secondary air into the exhaust gas burn-out zone, wherein the secondary air must be mixed with the exhaust gas as well as possible.

Because of the inhomogeneity of the combustion material and the variations in the primary gas admitted to the solid bed combustion zone but also because of the different charges the spatial distribution and absolute concentrations of the exhaust gas species are distributed very heterogeneously and, additionally subject to strong fluctuations. Measurements, taken in the burnout zone, show air streaks with very high concentration of incompletely burned compounds. This results in an incomplete gas burnout with for example high CO peaks. In addition, particularly the incomplete burn out of soot particles, results in a high carbon concentration in the wall deposits an increased formation rate of PCDD/F (de-novo synthesis).

Technical apparatus for optimizing the exhaust gas burnout in combustion plants are designed particularly to reduce the emissions using controlled injection of oxygen-containing secondary gases which results in a reduction of emissions in the exhaust gas burnout zone formed in the exhaust gas discharge duct. As secondary gases for example more or less oxygen-containing air, recycled exhaust gas or also steam (with over-stoichiometric air) may be used.

In order to ensure a complete combustion secondary gas is injected into the exhaust gas burnout zone with a high impulse, and, to ensure good penetrations of the exhaust gas flow, in large excess quantities. The intense mixing of unburned exhaust gas components with the oxygen-containing secondary air at high temperatures is required for an effective exhaust gas burn out.

In [1] various concepts and apparatus for the injection of secondary air which are independent of local- and time-based condition changes, are described. The injection is performed in a first concept with nozzles, which are arranged exclusively around the burnout chamber wall. A turbulent mixing of the injected secondary air with the exhaust gas flow is attempted to be achieved by an optimal arrangement and orientation of the injection nozzles in the burnout chamber wall. It is consequently tried to obtain certain two- or three-dimensional flow patterns such as rolling flows or flow turbulences only by the arrangement and orientation of the nozzles. In a second concept, a cross-tube with additional nozzles is disposed in the narrowest flow cross-section that is in the transition from the combustion chamber to the radiation passage. A first variant of this concept uses a rotating tube, type Temelli, whereas a second variant is based on a flow-optimized stationary crosstube, type Kümmel.

A reliable mixing of secondary gas via injection nozzles which are arranged exclusively in the burnout chamber wall requires that certain flow patterns are maintained in order to obtain a homogenizing mixing process. Such concepts are therefore only conditionally suitable for instationary combustion processes as they occur for example in connection with the treatment of thermal waste materials. An inhomogeneous consistency of the waste material, which serves as fuel, amplifies this influence factor particularly strongly. This limitation is even more apparent with an increasing cross-section of the burn-out zone since the distances to be bridged by the injected secondary gas during the mixing process become larger.

It is therefore the object of the present invention to provide an apparatus and a method for optimizing the burn-out of exhaust gases such that even in instationary combustion processes a complete burn-out is achieved with a minimum of secondary gases.

SUMMARY OF THE INVENTION

In an apparatus and method for optimizing the exhaust gas burnout in combustion plants having a solid bed combustion zone and an exhaust gas burnout zone wherein oxygen-containing gas is injected into the exhaust gas flow in the burnout zone by way of a plurality of secondary gas injection nozzles, wherein each injection nozzle is provided with a control valve, means are provided for determining the presence of incompletely burned exhaust gas components in the exhaust gas burn out zone and a control unit converts the signals into control signals by which the valves or group of valves are individually controlled so as to inject oxygen containing gas into the exhaust gas flow in order to concentrate the injection of the oxygen containing secondary gas into the areas in which incompletely burned exhaust gas components are present.

The nozzles can be individually controlled or in groups. With such an arrangement secondary air can be injected in the mixing area into the various segments into which the mixing area is divided in an individually controlled manner depending on the secondary air needs in a particular segment.

The essential features of the arrangement according to the invention comprise means for the time-dependent selective determination of local concentrations of incompletely burned gas components in the effective area. If the local distribution of these gas components in the effective area is known, with an individually controlled injection of secondary gases into each segment, an optimized burnout of the exhaust gas can be achieved in an advantageous manner without the need for the large excess quantities of secondary air required in connection with state of the art arrangements. The local and time-dependent resolution of the selective determination is obtained from the geometric conditions and the flow-dynamics in the exhaust gas burnout zone.

Secondary air is mixed into the exhaust gas volume flow in the injection area which is so dimensioned and so arranged in the exhaust gas burnout zone that preferably the whole exhaust gas volume flow is conducted through the injection area. The nozzles are so arranged in this area that the secondary gas can be injected in the whole area into the various segments in a controlled manner. The injection area should preferably be arranged in the exhaust gas burn-out zone as part of a radiation structure passage with a finite cross-section in such a way that, at least in this cross-section, it extends fully across the radiation structure cross-section.

In the various sections, the concentrations are measured and the respective signals are supplied to a control unit which converts the concentration signals into control signals for controlling individually each injection nozzle or group of nozzles for the controlled injection of secondary gas. The sensing means and the control unit may be combined in a measuring and control unit. If the local and time-based variable concentrations are to be determined, the measuring and control unit could include a computer unit which, via suitable computer programs, converts the measured concentration values not only into control signals but which also compares the reaction of the exhaust gases in the various segments or the time-dependent dynamics of the exhaust gases, of the combustions and the follow-up combustions as well as the delays and dead times of the secondary injection nozzles and takes these facts into consideration for the control of the individual nozzles or group of nozzles.

The above measuring and control system forms with the secondary gas injection, the exhaust gases and the secondary combustion a closed control circuit. The individual segments of the secondary combustion area are to be only considered as different sections for computation considerations, they are not physically different sections. The measuring and control system, the secondary air injection area and the air injection systems can be optimized with computer-based simulations based on corresponding model considerations before their application in secondary combustion control.

Optimizations show basically the advantageous results obtained if the amount that is the full volume flow of injected secondary air is not uniformly distributed but is controlled depending on the determined local concentrations of incompletely burned gas components in the exhaust gas.

For a determination of the required partial secondary gas flow volumes, the qualitative determination of the local concentrations of carbon monoxide, hydrocarbons and/or soot is sufficient. For such a determination, a spectral camera is particularly suitable which is directed in the area of the combustion chamber wall toward the exhaust gas burnout zone and completely covers the effective area. With an appropriate focusing of the camera lens certain distance intervals can be selected for a concentration determination.

For the determination of the characteristic radiation spectra of the unburned exhaust gas components mentioned above an infrared camera for wavelength ranges of 3 to 12 μm is particularly advantageous. Hydrocarbons with characteristic wavelength maxima in the range of 3 μm (for methane) carbon dioxide with characteristic wavelength maxima in the range of 48 μm and soot can be qualitatively determined by image evaluation techniques. Also carbon dioxide and water can be determined with this method.

Particularly carbon monoxide components can be determined with the described optical determination method, wherein the radiation spectrum of carbon monoxide becomes more intense with increasing temperature and therefore can be determined better and more distinctly. Below this temperature range however carbon monoxide has not only a substantially lower 1R-emission intensity but can also not be oxidized to carbon dioxide by the injection of secondary air without separate energy input. Therefore advantageously only the carbon monoxide is determined which is actually burned by secondary air.

The invention also resides in a method for optimizing the exhaust gas burn out in a combustion plant with a solid bed combustion zone and an exhaust gas burnout zone.

For performing the method, the apparatus or arrangement as described above is needed. Consequently, also with the method, a controlled injection of oxygen containing secondary air into an active area of the exhaust gas burnout zone via several controllable nozzles and the measurement of the oxygen for the determination of the total amount of secondary and primary air in the exhaust gas is necessary. The method comprises the determination of local concentrations of individual incompletely burned gas components in the exhaust gas burnout zone at least in the effective area, a conversion of the determined local concentrations into signals and a conversion of the concentration signals into control signals for each of the controllable secondary air nozzles or nozzle groups as described in detail earlier for the apparatus according to the invention.

Below, an embodiment of the invention will be described in greater detail on the basis of the accompanying Drawings.

DESCRIPTION OF A PREFERRED EMBODIMENT

Figure 1:
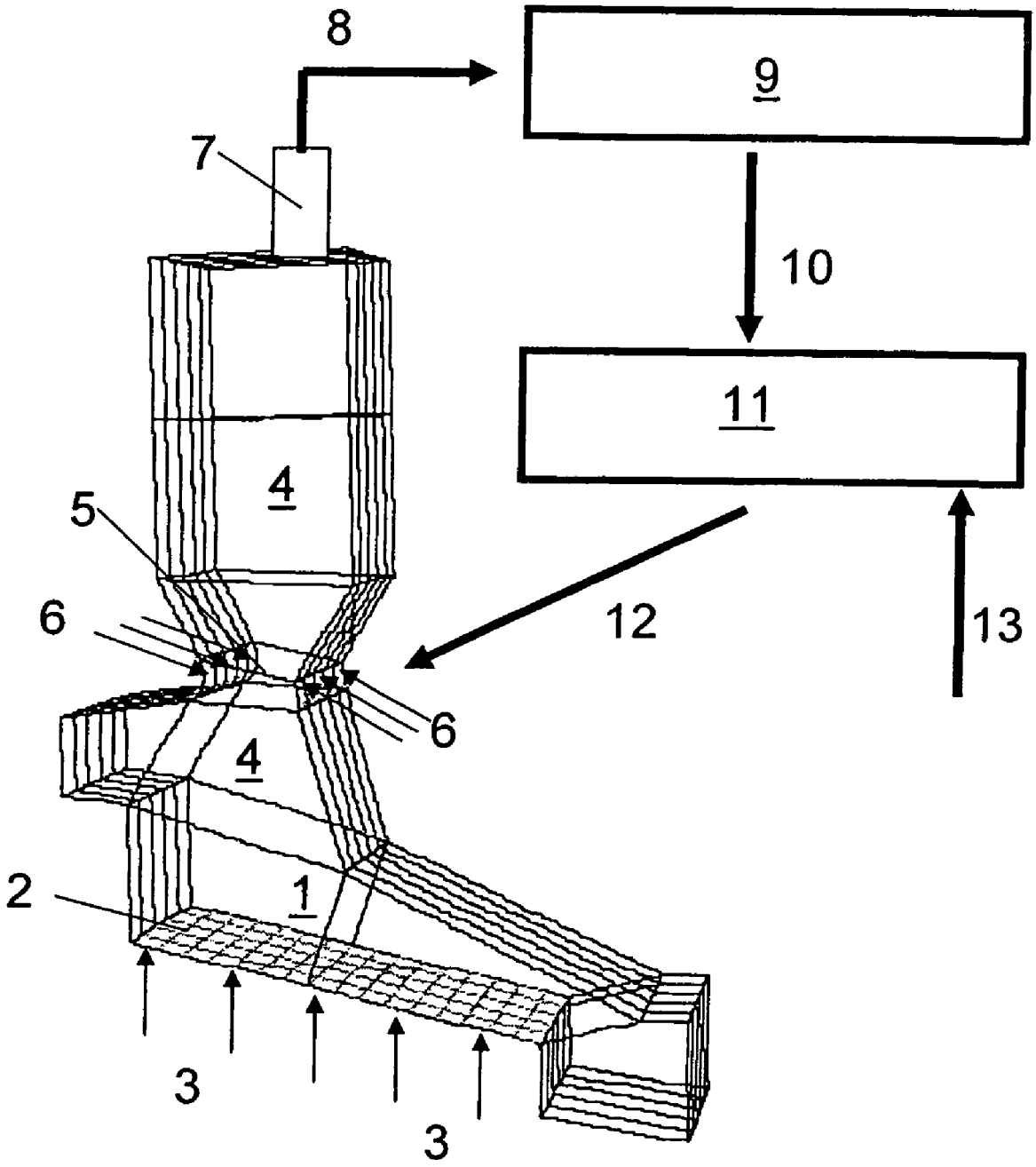
FIG. 1 shows schematically a waste combustion plant with a solid bed—and an exhaust gas burn out zone, an IR-camera, a measuring and control unit, and an effective burnout area.

The plant arrangement and the method for optimizing the exhaust gas burn out are best described on the basis of the schematic representation shown in FIG. 1. It shows a solid bed combustion zone 1 with a combustion grate 2 through which a primary gas 3 is supplied. The actual combustion occurs in the solid bed combustion zone 1, from where the exhaust gases are conducted into an exhaust gas burnout zone 4. For achieving a complete secondary combustion of the exhaust gases, an oxygen-containing secondary gas 6 is injected into the exhaust gas in the burnout zone via controllable nozzles. The area of the burnout zone in which the secondary air injection actually occurs, is the effective area 5. It covers preferably the narrowest cross-section of the exhaust gas burnout zone 4, and all the exhaust gas flows through the effective area and is surveilled by an IR camera 7.

By means of the IR camera 7, the infrared radiation emitted from the unburned components of the exhaust gases in the effective area of the exhaust gas burnout zone within a selected spectral range interval is recorded and transmitted to a processing unit 9 (part of a control unit) in the form of infrared signals 8. In the control unit 9, from the infrared signals, the concentration distribution of unburned exhaust gas components over the cross-section of the active area is qualitatively determined. As guide parameter for unburned exhaust gas species, the carbon monoxide (CO) is used herein. Based on this information (represented by the concentration signals 10) in a control unit 11 (also part of the measuring and control unit) the respective locally required secondary air amount for each nozzle is determined that is the respective control signals 12 for the controllable secondary air injection nozzles are generated. For the formation of the control signals and the secondary air injection, the following parameters are important: location and extension of the desired injection into the effective area as well as the respective local CO concentration. The control signals for the injection nozzles are so selected that the secondary gas is injected into the CO strands as directly as possible. Also, the intensity of the injection depends on the determined CO concentration, wherein the secondary gas amount to be injected is correlated to a complete burn out in principle determined on the basis of the CO concentration. The total secondary gas flow available for the injection is entered into the control unit as the desired value.

Figure 2:
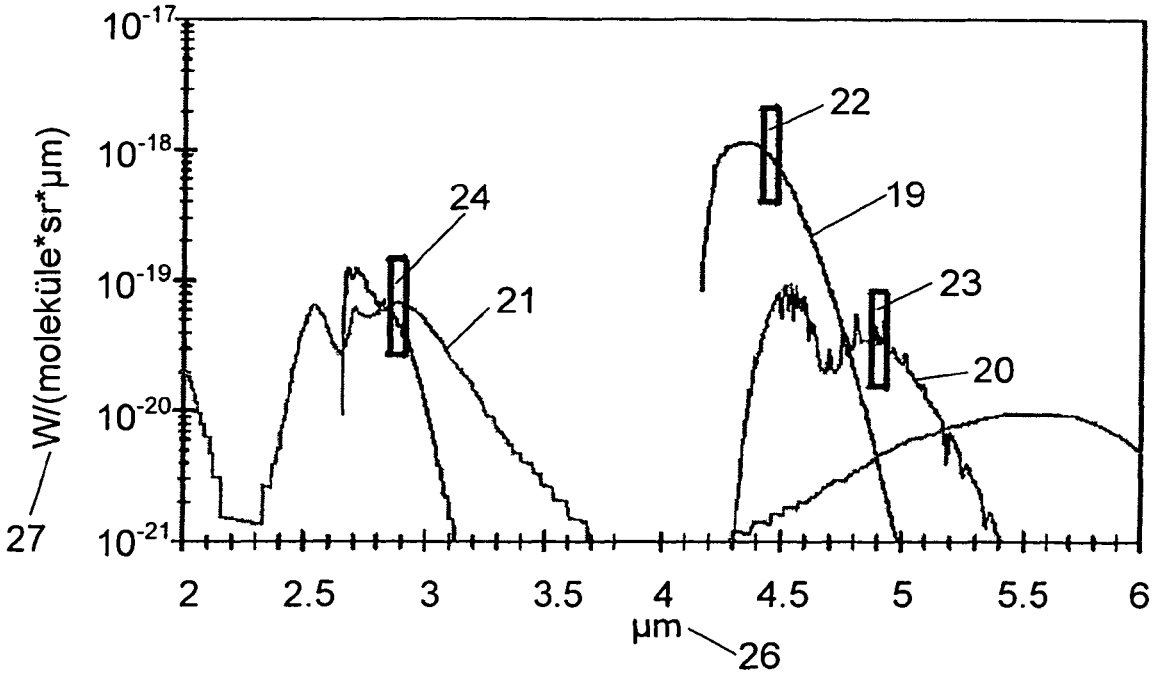
FIG. 2 shows the characteristic IR radiation spectra of carbon monoxide, carbon dioxide and water.

The radiation emission spectra of the individual exhaust gas components (emission intensities 27 in W/molecule*sr*μm), wherein sr is the spatial angle) are given in FIG. 2 dependent on the exciting wavelength 26 between 2 and 6 μm wavelength (from [2]). They show the spectral lines for carbon dioxide 19, carbon monoxide 20, steam 21.

Figure 3:
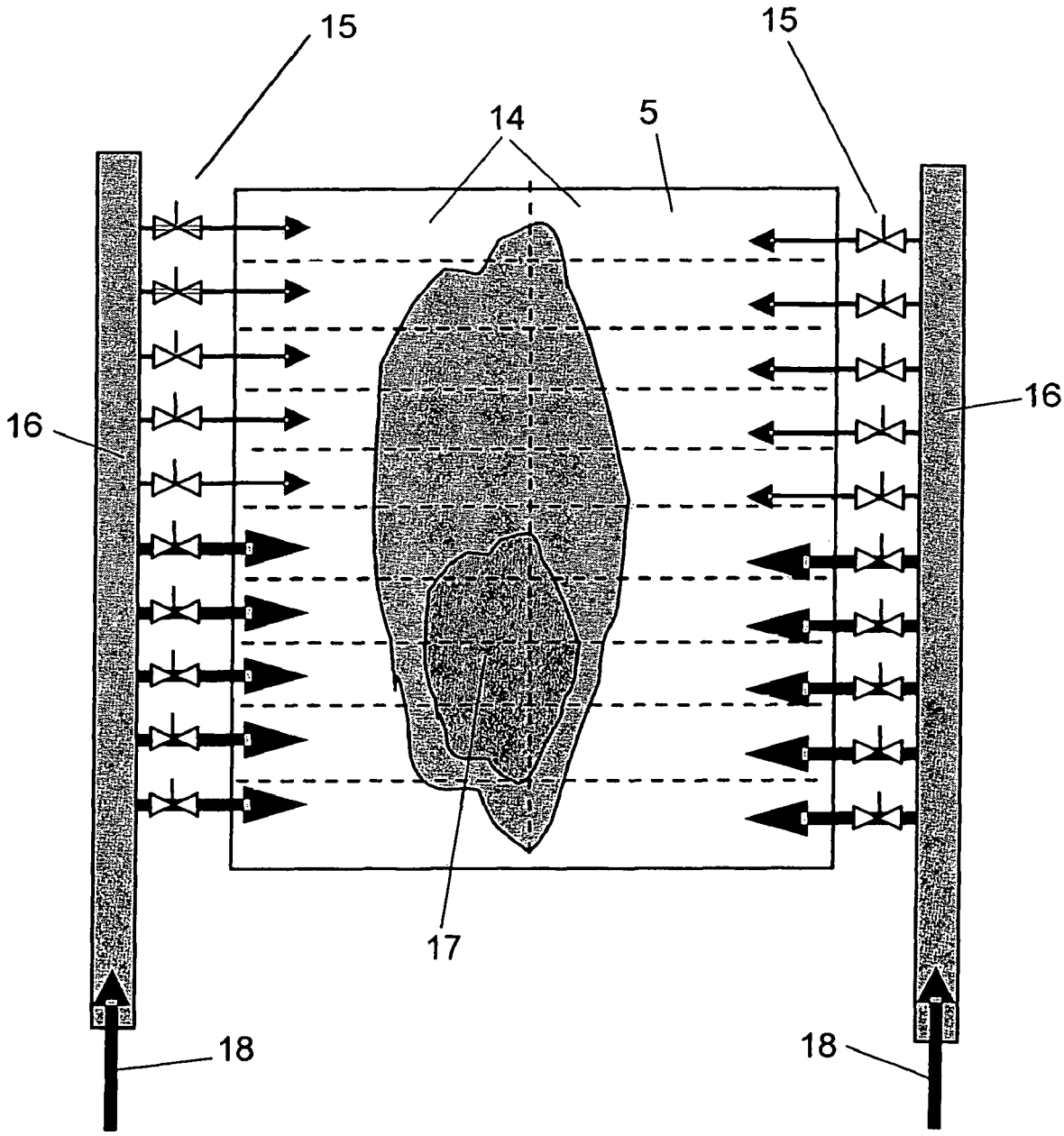
FIG. 3 shows schematically a concentration distribution in the effective burnout area and the secondary air injection based thereon.

FIG. 3 shows a spatial distribution as calculated from the camera signals in the cross-section of the effective area 5 of the exhaust gas burnout zone 4 as an example for CO. The effective area 5 is divided by lines into several zones 14, into each of which secondary gas can be injected by way of a secondary gas rail 16.

Furthermore, FIG. 3 shows the CO concentration distribution in the effective area 5, wherein a certain gray shade represents a certain adjustable concentration area. In the present case, in the effective area 6, a CO strand 17 can be seen enhanced by a comparably dark area.

For achieving a complete burnout, the partial gas jets of secondary gas (shown in FIG. 2 by arrows extending from the nozzles 15) are increased in the area of the CO strand 17 (thickened arrows in FIG. 2), while at the same time the injection gas flow is decreased (thinner arrows in FIG. 3).

The determination of the concentration distribution in the effective area 5 occurs at short time intervals as much as possible in the range of 1 to 5 seconds, so that the success of the air injection can be constantly controlled. In accordance therewith, the secondary individual gas injection jets are practically continuously and automatically adjusted according to the actual requirements.

The control range of the individual secondary combustion gas jets is within firmly defined limits that is a minimum and a maximum value. The overall secondary gas or air volume flow is not affected by the method described herein. The respective desired value 13 (FIG. 1) for the overall gas flow volume is provided by a superimposed control system which is normally installed in larger plants.

LITERATURE

[1] K. Görner, Th. Klasen: Sekondärluftprisma zur Optimierung der Sekondärlufteindüusung; Umdruck zum VDI-Seminar: BAZ-und preisorientierte Dioxin-/Gesamtemissionsminderungstechniken 2000 (14./15. 9. 2000 in München)

[2] Rawlins, W. T. Lawrence, W. G. Marinelli, W. J. Allen, M. G.: Hyperspectral Infrared Imaging of Flames using a Spectrally Scanning Fabry-perot Filter; Proc. 6. Int. Microgravity Combustion Workshop, NASA Glenn Research Center, Cleveland, Pages 57-60, 2001.

What is claimed is:

1. An apparatus for optimizing the exhaust gas burnout in combustion plants having a solid bed combustion zone (1) and an exhaust gas burnout zone (4) in which oxygen-containing secondary gas (6) is mixed with the combustion gas in an effective area (5) of the exhaust gas burnout zone (4), comprising a plurality of oxygen-containing secondary gas injection nozzles (15) each including a control valve for controlling the flow volume through each individual nozzle into a particular cross-section of the effective area (5), an infrared camera for determining the presence of incompletely burned exhaust gas components in distinctive cross-sections of the effective area (5) and a device measuring spectral radiation including a filter selecting a limited wave range for providing, upon detection of such incompletely burned exhaust gas components in a particular cross-section, signals representing local concentrations of gas components of at least one of carbon monoxide, hydrocarbons and soot, and a control unit converting these signals into control signals for controlling the control valves of the individual nozzles serving the respective cross-sections in which the presence of incompletely burned exhaust gas components is indicated for controlling the injection of the oxygen-containing secondary gas specifically to the particular cross-sections in which the presence of incompletely burned exhaust gas components has been detected.

2. An apparatus according to claim 1, wherein the burnout zone is part of one of an exhaust gas duct and a radiation duct, which has a predetermined cross-section and the effective area of the exhaust gas burnout zone (5) is formed at least at one location with a reduced flow cross-section of the exhaust gas duct.

3. An apparatus according to claim 1, wherein the control unit includes a computer unit which determines from the signals supplied by the means for determining the presence of incompletely burned exhaust gas local concentrations and time-based changes of the concentrations and takes these determinations into consideration for the conversion of the signals into control signals for generating the control values for the injection nozzles.

4. An apparatus according to claim 3, wherein the amount of secondary oxygen containing gas introduced into the exhaust gas depends on the determined concentration of incompletely burned exhaust gas components in the exhaust gas and is adjusted by the control signal calculated by the computer of the control unit.

* * * * *